US008819892B1

(12) United States Patent
Mangum

(10) Patent No.: US 8,819,892 B1
(45) Date of Patent: Sep. 2, 2014

(54) ELECTRICAL MAID

(76) Inventor: Marella Bettina Mangum, Minot, ND (US)

( * ) Notice: Subject to any disclaimer, the term of this patent is extended or adjusted under 35 U.S.C. 154(b) by 11 days.

(21) Appl. No.: 13/492,994

(22) Filed: Jun. 11, 2012

Related U.S. Application Data

(60) Provisional application No. 61/530,088, filed on Sep. 1, 2011.

(51) Int. Cl.
*A47L 5/38* (2006.01)

(52) U.S. Cl.
USPC ..... 15/302; 15/312.1

(58) Field of Classification Search
USPC ..... 15/301, 302, 312.1
IPC ..... A47L 5/38
See application file for complete search history.

(56) References Cited

U.S. PATENT DOCUMENTS 4,025,984 A * 5/1977 Hoener, Jr. ..... 15/302
4,797,969 A * 1/1989 Caduff ..... 15/302
6,090,221 A * 7/2000 Gan et al. ..... 134/21

* cited by examiner

*Primary Examiner* — David Redding
(74) *Attorney, Agent, or Firm* — Plager Schack, LLP

(57) ABSTRACT

An automatic cleaning system comprises a control panel communicatively coupled to a sprinkler device and a cleaning apparatus. The sprinkler device emits a heat and deodorizer for intense drying and sterilization. The cleaning apparatus removes the cleaning solution, sweeps mops, vacuums, shampoos and waxes floors.

4 Claims, 4 Drawing Sheets

ELECTRICAL MAID

CROSS REFERENCE TO RELATED APPLICATIONS

This application claims priority to provisional patent application No. 61/530,088 filed on Sep. 1, 2011.

FIELD OF THE INVENTION

This invention relates self-cleaning enclosed spaces.

BACKGROUND OF THE INVENTION

Since the beginning of human history cleaning has been a largely manual process. As technology for cleaning developed more comprehensive and effective cleaning solvents, the cleaning process became more effective, but also more dangerous. Exposure to chemicals can affect the health of a user. This problem was mitigated in recent years by the development of apparatus that can clean enclosed spaces independent of a user. However, those apparatus have not taught a comprehensive cleaning solution independent of user labor as is disclosed below.

BRIEF SUMMARY OF THE INVENTION

An automatic cleaning system comprises a control panel communicatively coupled to a sprinkler device and a cleaning apparatus. The sprinkler device emits a cleaning solution and the cleaning apparatus removes the cleaning solution. The cleaning apparatus can also sweep, mop, shampoo, vacuum or wax floors.

BRIEF DESCRIPTION OF THE SEVERAL VIEWS OF THE DRAWINGS

Figure 1:
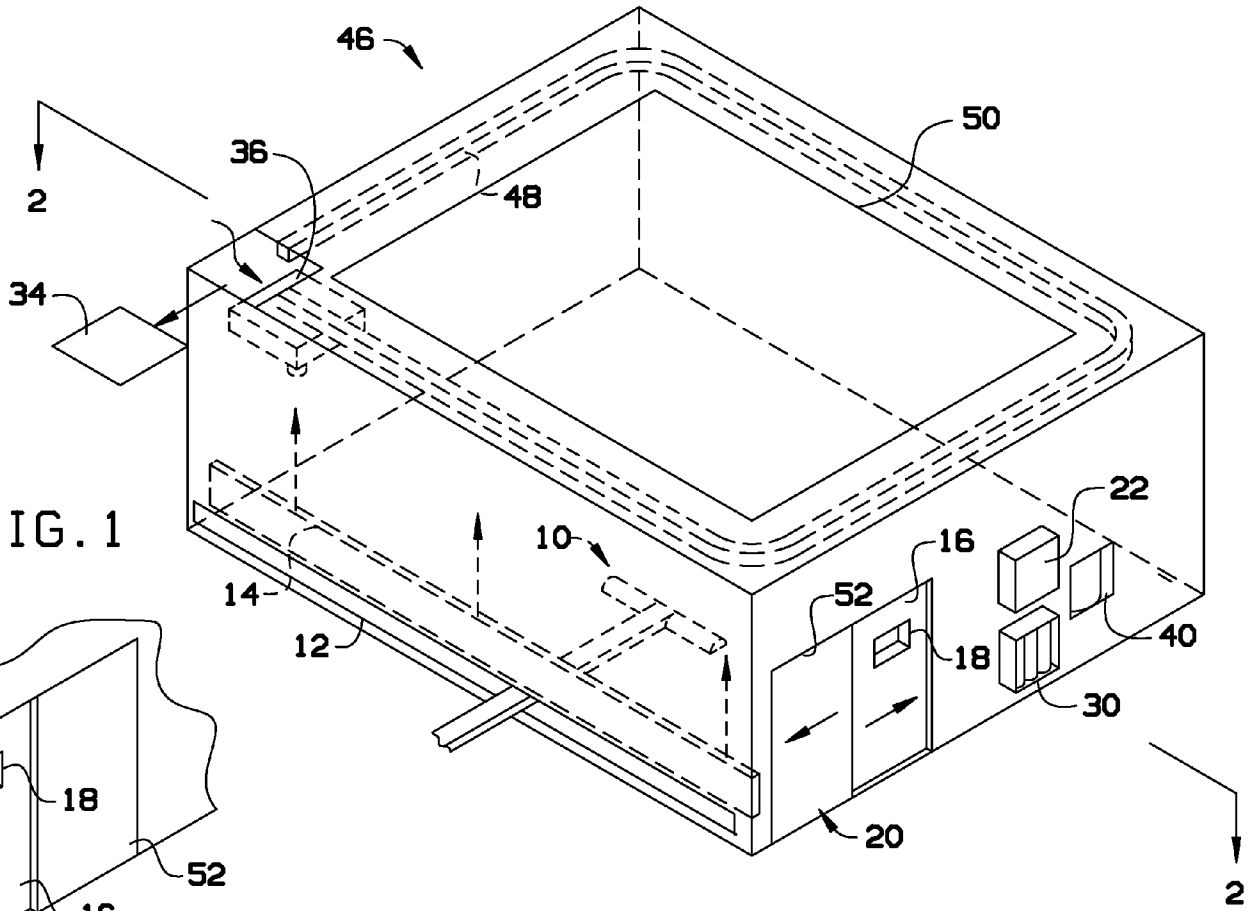

Having thus described the invention in general terms, reference will now be made to the accompanying drawings, which are not necessarily drawn to scale, and wherein:

FIG. 1 is a perspective view of the invention.

Figure 2:
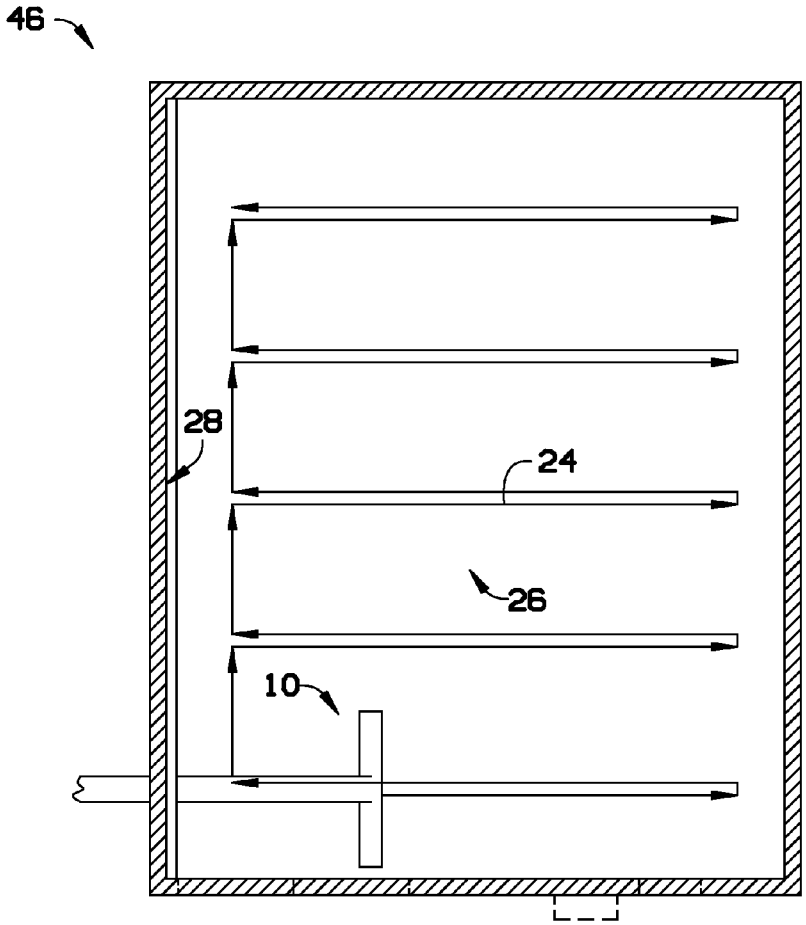

FIG. 2 is a section view of the invention along line 2-2 in FIG. 1 illustrating the apparatus cleaning path.

Figure 3:
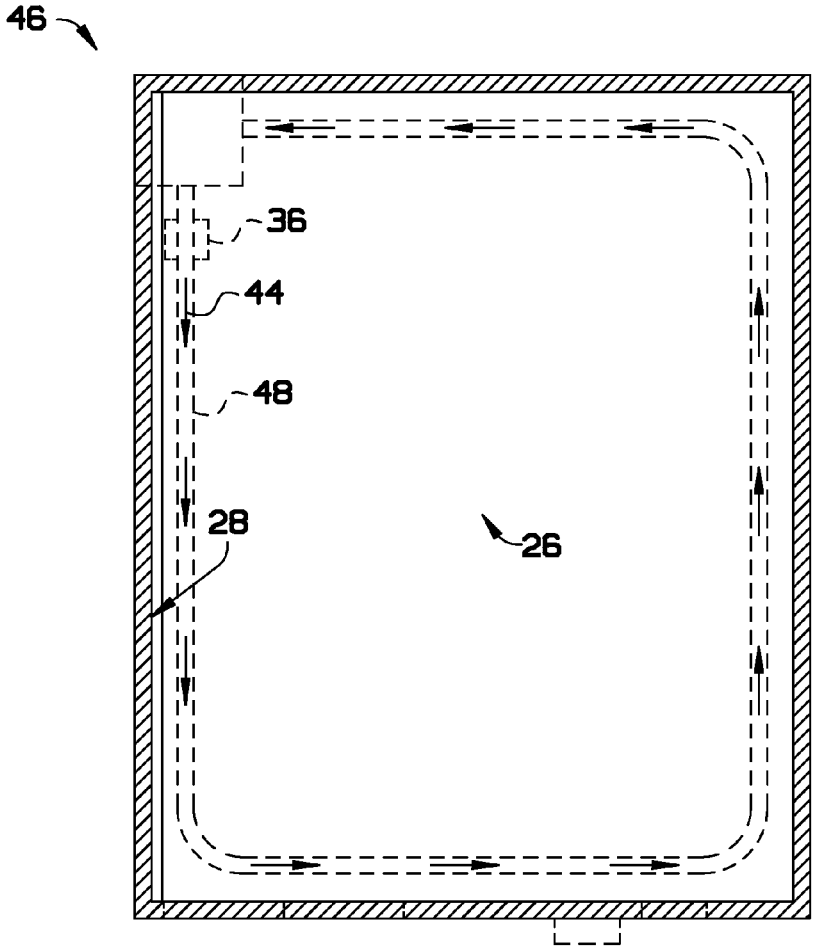

FIG. 3 is a section view of the invention illustrating the sprinkler path.

Figure 4:
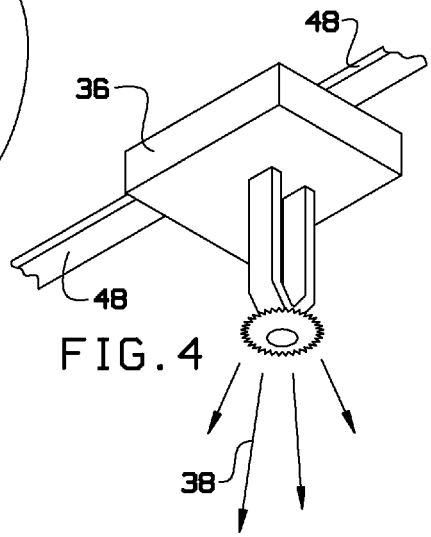

FIG. 4 is a perspective detail view of the invention.

Figure 5:
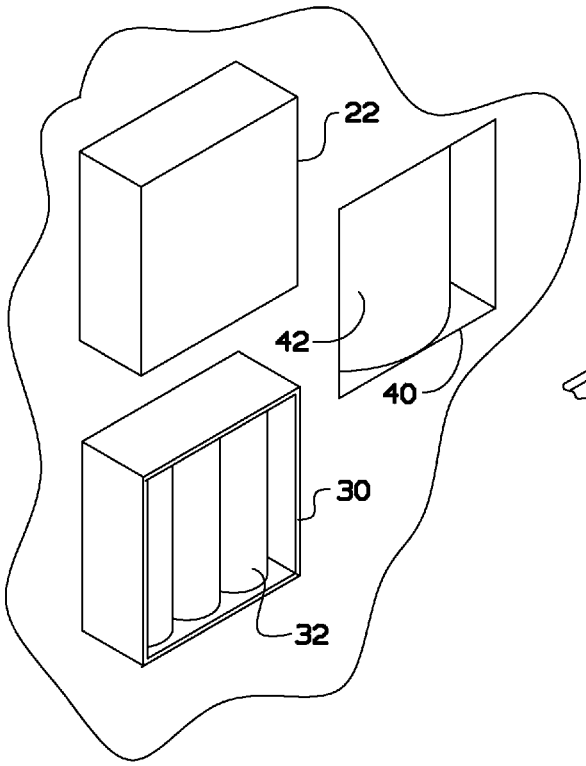

FIG. 5 is a lower perspective detail view of the invention.

Figure 6:
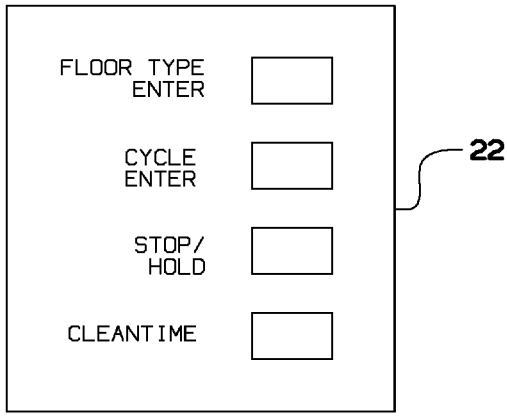

FIG. 6 is a front detail view of the invention.

Figure 7:
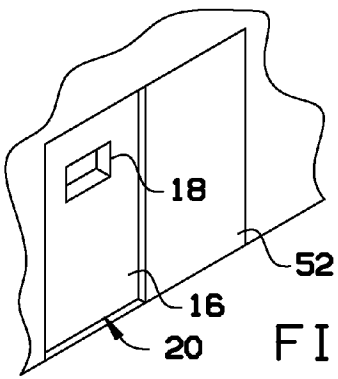

FIG. 7 is a perspective detail of the invention showing the original door in use.

DETAILED DESCRIPTION OF THE INVENTION

Embodiments of the present invention overcome many of the obstacles associated with automatic comprehensive cleaning of a room, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 and FIG. 7 shows the invention. Room 46 comprises an automatic cleaning system. The automatic cleaning system further comprises sprinkler device 36. Sprinkler device 36 travels along the sprinkler track 48 and can be accessed by removing the roof corner panel 34 and sliding back the parameter panel to expose sprinkler track 48. Sprinkler device 36 emits the cleaning solution throughout room 46 as will be explained below. Cleaning apparatus 10 is mechanically coupled to apparatus track 12. Cleaning apparatus 10 can clean room 46 as explained below. Cleaning apparatus 10 is not normally in room 46 rather cleaning apparatus 10 is held on an opposite side of the wall and in terms upon lifting sliding baseboard 14 in the direction shown by the arrows. Original door 52 is located on a first wall of room 46. Original door 52 can slide along door notch 20. Sliding metal door 16 can slide along the door notch 20. Sliding metal door 16 further comprises window 18. The first wall of room 46 further comprises control panel 22 canister panel 30 and vacuum canister panel 40.

FIG. 2 shows apparatus cleaning path 24. Room 46 further comprises floor 26 and first wall 28, second wall 28, third wall 28, and fourth wall 28. As explained above cleaning apparatus 10 enters room 46 through second wall 28. Cleaning apparatus 10 then travels along path 24 to clean room 46.

FIG. 3 and FIG. 4 show sprinkler track 48. As shown here, sprinkler device 36 begins in a corner of the room 46 defined by the intersection of second wall 28 and third wall 28. Sprinkler device 36 travels in a counterclockwise manner along sprinkler track 48 along second wall 28, then along first wall 28, then long fourth wall 28, and finally back to the corner of second wall 28 and third wall 28. As sprinkler 36 travels along sprinkler track 48, sprinkler 36 emits cleaning solution 38. That cleaning solution will cover the entire surface of floor 26 along with first wall 28, second wall 28, third wall 28, fourth wall 28 and the ceiling of room 46. The solution will completely disinfect room 46. And then the solution will be removed by cleaning apparatus 10, as explained below.

FIG. 5 shows first wall 26 in more detail. Control panel 22 is communicatively coupled to sprinkler 36 and cleaning apparatus 10. Vacuum canister panel 40 further comprises vacuum canister 42. Vacuum canister 42 and cleaning solution canister 32 are mechanically coupled to cleaning apparatus 10 in use. Cleaning apparatus 10 vacuums cleaning solution 38 from floor 26, and then deposits whatever is vacuumed into a plumbing system for room 46. In other embodiments cleaning apparatus 10 can act as a broom, mop, carpet shampooer, vacuum or waxing apparatus. Canister panel 30 further comprises cleaning solution canister 32. Cleaning solution canister 32 is mechanically coupled to sprinkler 36. In some embodiments, water can be combined with cleaning solution 38 and then moved from canister 32 to sprinkler device 36 by a pump or similar device.

FIG. 6 shows control panel 22 in more detail. The user can program the automatic cleaning system by importing the floor type and the type of cycle. For example, one cycle can include sweeping, mopping, washing with a sprinkler device, drying, disinfecting and deodorizing. A user can stop the automatic cleaning system with the stop/hold button; the amount of clean time remaining will be displayed next to the clean time label.

That which is claimed:

1. An automatic cleaning system configured to clean a room; the automatic cleaning system comprising:

a control panel communicatively coupled to a sprinkler device attached near a ceiling of the room and a cleaning apparatus attached near a floor of the room;

wherein the sprinkler device is configured to emit a cleaning solution throughout the room onto the floor;

wherein the cleaning apparatus removes the cleaning solution from the floor with a vacuum and then pumps the solution to a sewer; and wherein the cleaning apparatus is further configured to sweep, mop, vacuum, shampoo and wax the floor.

2. The automatic cleaning system of claim 1, further comprising, the sprinkler device is mechanically coupled to a sprinkler track and a cleaning solution canister.

3. The automatic cleaning system of claim 1, further comprising, the sprinkler device is mechanically coupled to a sprinkler track and a cleaning solution canister; and the cleaning apparatus is mechanically coupled to a vacuum canister and cleaning solution canister.

4. The automatic cleaning system of claim 1, further comprising, the sprinkler device is mechanically coupled to a sprinkler track and a cleaning solution canister;

the cleaning apparatus is mechanically coupled to a vacuum canister and a cleaning solution canister, the sprinkler device travels along the sprinkler track; and the cleaning apparatus travels along an apparatus cleaning path.

* * * * *